US007905119B2

(12) United States Patent
Pinkowski et al.

(10) Patent No.: US 7,905,119 B2
(45) **Date of Patent: *Mar. 15, 2011**

(54) FABRIC TREATMENT APPLIANCE WITH STEAM GENERATOR HAVING A VARIABLE THERMAL OUTPUT

(75) Inventors: Robert J. Pinkowski, Baroda, MI (US); Alvaro Vallejo Noriega, St. Joseph, MI (US); Markus Beck, Remseck (DE); Karl Furderer, Stuttgart (DE); Floyd G. Jackson, Baroda, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 220 days.

This patent is subject to a terminal disclaimer.

(21) Appl. No.: 11/848,550

(22) Filed: Aug. 31, 2007

(65) Prior Publication Data

US 2009/0056389 A1 Mar. 5, 2009

(51) Int. Cl.
*B08B 3/12* (2006.01)

(52) U.S. Cl. ..... 68/5 C; 392/397; 392/399; 392/480

(58) Field of Classification Search ..... 68/5 C; 392/397, 399, 480

See application file for complete search history.

(56) References Cited

U.S. PATENT DOCUMENTS

| | | | |
|---|---|---|---|
| 369,609 | A | 9/1887 | Montanye |
| 382,289 | A | 5/1888 | Ballard |
| 480,037 | A | 8/1892 | Rowe et al. |
| 647,112 | A | 4/1900 | Pearson |
| 956,458 | A | 4/1910 | Walter |
| 1,089,334 | A | 3/1914 | Dickerson |
| 1,616,372 | A | 2/1927 | Janson |
| 1,676,763 | A | 7/1928 | Anetsberger et al. |
| 1,852,179 | A | 4/1932 | McDonald |
| 2,314,332 | A | 3/1943 | Ferris |
| 2,434,476 | A | 1/1948 | Wales |
| 2,778,212 | A | 1/1957 | Dayton et al. |
| 2,800,010 | A | 7/1957 | Dunn |
| 2,845,786 | A | 8/1958 | Chrisman |
| 2,881,609 | A | 4/1959 | Brucken |
| 2,937,516 | A | 5/1960 | Czaika |
| 2,966,052 | A | 12/1960 | Syles |
| 3,035,145 | A | 5/1962 | Rudolph |
| 3,060,713 | A | 10/1962 | Burkall |

(Continued)

FOREIGN PATENT DOCUMENTS

| | | | |
|---|---|---|---|
| CA | 1330526 | C | 7/1994 |

(Continued)

OTHER PUBLICATIONS

Definition of serpentine from webster dictionary published 1996.*

(Continued)

*Primary Examiner* — Michael Barr
*Assistant Examiner* — Samuel A Waldbaum
(74) *Attorney, Agent, or Firm* — Clifton G. Green; McGarry Bair PC

(57) ABSTRACT

A steam generator according to one embodiment of the invention includes a steam generation chamber for converting the water to steam, and a heating element thermally coupled with the steam generation chamber and having a first portion below an operational water level of the steam generation chamber and a second portion above the operational water level, with the first portion having a greater thermal output than the second portion.

22 Claims, 11 Drawing Sheets

U.S. PATENT DOCUMENTS

| | | | | |
|---|---|---|---|---|
| 3,223,108 | A | | 12/1965 | Martz, Jr. |
| 3,234,571 | A | | 2/1966 | Buss |
| 3,347,066 | A | | 10/1967 | Klausner |
| 3,498,091 | A | | 3/1970 | Mason |
| 3,550,170 | A | | 12/1970 | Davis |
| 3,697,727 | A | * | 10/1972 | Neuman et al. ..... 219/532 |
| 3,707,855 | A | | 1/1973 | Buckley |
| 3,712,089 | A | | 1/1973 | Toth |
| 3,801,077 | A | | 4/1974 | Pearson |
| 3,830,241 | A | | 8/1974 | Dye et al. |
| 3,869,815 | A | | 3/1975 | Bullock |
| 3,890,987 | A | | 6/1975 | Marcussen et al. |
| 3,935,719 | A | | 2/1976 | Henderson |
| 4,020,396 | A | | 4/1977 | Gambale et al. |
| 4,034,583 | A | | 7/1977 | Miessler |
| 4,045,174 | A | | 8/1977 | Fuhring et al. |
| 4,108,000 | A | | 8/1978 | Norris |
| 4,177,928 | A | | 12/1979 | Bergkvist |
| 4,207,683 | A | | 6/1980 | Horton |
| 4,214,148 | A | | 7/1980 | Fleischhauer |
| 4,263,258 | A | | 4/1981 | Kalasek |
| 4,332,047 | A | | 6/1982 | Kuttelwesch |
| 4,373,430 | A | | 2/1983 | Allen |
| 4,386,509 | A | | 6/1983 | Kuttelwesch |
| 4,432,111 | A | | 2/1984 | Hoffmann et al. |
| 4,489,574 | A | | 12/1984 | Spendel |
| 4,496,473 | A | | 1/1985 | Sanderson |
| 4,527,343 | A | | 7/1985 | Danneberg |
| 4,646,630 | A | | 3/1987 | McCoy et al. |
| 4,761,305 | A | | 8/1988 | Ochiai |
| 4,777,682 | A | | 10/1988 | Dreher et al. |
| 4,784,666 | A | | 11/1988 | Brenner et al. |
| 4,809,597 | A | | 3/1989 | Lin |
| 4,879,887 | A | | 11/1989 | Kagi et al. |
| 4,920,668 | A | | 5/1990 | Henneberger et al. |
| 4,987,627 | A | | 1/1991 | Cur et al. |
| 4,991,545 | A | | 2/1991 | Rabe et al. |
| 5,032,186 | A | | 7/1991 | Childers et al. |
| 5,050,259 | A | | 9/1991 | Tsubaki et al. |
| 5,052,344 | A | | 10/1991 | Kosugi et al. |
| 5,058,194 | A | | 10/1991 | Violi |
| 5,063,609 | A | | 11/1991 | Lorimer |
| 5,107,606 | A | | 4/1992 | Tsubaki et al. |
| 5,146,693 | A | | 9/1992 | Dottor et al. |
| 5,152,252 | A | | 10/1992 | Bolton et al. |
| 5,154,197 | A | | 10/1992 | Auld et al. |
| 5,172,654 | A | | 12/1992 | Christiansen |
| 5,172,888 | A | | 12/1992 | Ezekoye |
| 5,199,455 | A | | 4/1993 | Dlouhy |
| 5,212,969 | A | | 5/1993 | Tsubaki et al. |
| 5,219,370 | A | | 6/1993 | Farrington et al. |
| 5,219,371 | A | | 6/1993 | Shim et al. |
| 5,279,676 | A | | 1/1994 | Oslin et al. |
| 5,291,758 | A | | 3/1994 | Lee |
| 5,293,761 | A | | 3/1994 | Jang |
| 5,315,727 | A | | 5/1994 | Lee |
| 5,345,637 | A | | 9/1994 | Pastryk et al. |
| 5,570,626 | A | | 11/1996 | Vos |
| 5,619,983 | A | | 4/1997 | Smith |
| 5,727,402 | A | | 3/1998 | Wada |
| 5,732,664 | A | | 3/1998 | Badeaux, Jr. |
| 5,743,034 | A | | 4/1998 | Debourg et al. |
| 5,758,377 | A | | 6/1998 | Cimetta et al. |
| 5,768,730 | A | | 6/1998 | Matsumoto et al. |
| 5,774,627 | A | * | 6/1998 | Jackson ..... 392/497 |
| 5,815,637 | A | | 9/1998 | Allen et al. |
| 6,029,300 | A | | 2/2000 | Kawaguchi et al. |
| 6,067,403 | A | | 5/2000 | Morgandi |
| 6,094,523 | A | | 7/2000 | Zelina et al. |
| 6,122,849 | A | | 9/2000 | Kida et al. |
| 6,161,306 | A | | 12/2000 | Clodic |
| 6,178,671 | B1 | | 1/2001 | Zwanenburg et al. |
| 6,295,691 | B1 | | 10/2001 | Chen |
| 6,327,730 | B1 | | 12/2001 | Corbett |
| 6,434,857 | B1 | | 8/2002 | Anderson et al. |
| 6,451,066 | B2 | | 9/2002 | Estes et al. |
| 6,460,381 | B1 | | 10/2002 | Yoshida et al. |
| 6,585,781 | B1 | | 7/2003 | Roseen |
| 6,622,529 | B1 | | 9/2003 | Crane |
| 6,647,931 | B1 | | 11/2003 | Morgandi et al. |
| 6,691,536 | B2 | | 2/2004 | Severns et al. |
| 6,772,751 | B2 | | 8/2004 | Deuringer et al. |
| 6,789,404 | B2 | | 9/2004 | Kim et al. |
| 6,823,878 | B1 | | 11/2004 | Gadini |
| 6,874,191 | B2 | | 4/2005 | Kim et al. |
| 6,889,399 | B2 | | 5/2005 | Steiner et al. |
| 7,021,087 | B2 | | 4/2006 | France et al. |
| 7,096,828 | B2 | | 8/2006 | Tippmann |
| 7,290,412 | B2 | | 11/2007 | Yang et al. |
| 7,325,330 | B2 | | 2/2008 | Kim et al. |
| 7,404,304 | B2 | | 7/2008 | Yang et al. |
| 7,421,752 | B2 | | 9/2008 | Donadon et al. |
| 7,490,491 | B2 | | 2/2009 | Yang et al. |
| 7,490,493 | B2 | | 2/2009 | Kim et al. |
| 7,520,146 | B2 | | 4/2009 | Kim et al. |
| 7,600,402 | B2 | | 10/2009 | Shin et al. |
| 7,765,628 | B2 | | 8/2010 | Wong et al. |
| 2001/0032599 | A1 | | 10/2001 | Fischer et al. |
| 2003/0215226 | A1 | | 11/2003 | Nomura et al. |
| 2003/0226999 | A1 | | 12/2003 | Hage |
| 2004/0163184 | A1 | | 8/2004 | Waldron et al. |
| 2004/0187527 | A1 | | 9/2004 | Kim et al. |
| 2004/0187529 | A1 | | 9/2004 | Kim et al. |
| 2004/0200093 | A1 | | 10/2004 | Wunderlin et al. |
| 2004/0206480 | A1 | | 10/2004 | Maydanik et al. |
| 2004/0221474 | A1 | | 11/2004 | Slutsky et al. |
| 2004/0237603 | A1 | | 12/2004 | Kim et al. |
| 2004/0244432 | A1 | | 12/2004 | Kim et al. |
| 2004/0244438 | A1 | | 12/2004 | North |
| 2004/0255391 | A1 | | 12/2004 | Kim et al. |
| 2005/0000031 | A1 | | 1/2005 | Price et al. |
| 2005/0028297 | A1 | | 2/2005 | Kim et al. |
| 2005/0034248 | A1 | | 2/2005 | Oh et al. |
| 2005/0034249 | A1 | | 2/2005 | Oh et al. |
| 2005/0034250 | A1 | | 2/2005 | Oh et al. |
| 2005/0034487 | A1 | | 2/2005 | Oh et al. |
| 2005/0034488 | A1 | | 2/2005 | Oh et al. |
| 2005/0034489 | A1 | | 2/2005 | Oh et al. |
| 2005/0034490 | A1 | | 2/2005 | Oh et al. |
| 2005/0050644 | A1 | | 3/2005 | Severns et al. |
| 2005/0072382 | A1 | | 4/2005 | Tippmann |
| 2005/0072383 | A1 | | 4/2005 | Powell et al. |
| 2005/0092035 | A1 | | 5/2005 | Shin et al. |
| 2005/0132503 | A1 | | 6/2005 | Yang et al. |
| 2005/0132504 | A1 | | 6/2005 | Yang et al. |
| 2005/0132756 | A1 | | 6/2005 | Yang et al. |
| 2005/0144734 | A1 | | 7/2005 | Yang et al. |
| 2005/0144735 | A1 | | 7/2005 | Yang et al. |
| 2005/0205482 | A1 | | 9/2005 | Gladney |
| 2005/0220672 | A1 | * | 10/2005 | Takahashi et al. ..... 422/94 |
| 2005/0223503 | A1 | | 10/2005 | Hong et al. |
| 2005/0223504 | A1 | | 10/2005 | Lee et al. |
| 2005/0252250 | A1 | | 11/2005 | Oh et al. |
| 2005/0262644 | A1 | | 12/2005 | Oak et al. |
| 2006/0000242 | A1 | | 1/2006 | Yang et al. |
| 2006/0001612 | A1 | | 1/2006 | Kim |
| 2006/0005581 | A1 | | 1/2006 | Banba |
| 2006/0010613 | A1 | | 1/2006 | Jeon et al. |
| 2006/0010727 | A1 | | 1/2006 | Fung |
| 2006/0010937 | A1 | | 1/2006 | Kim et al. |
| 2006/0016020 | A1 | | 1/2006 | Park |
| 2006/0090524 | A1 | | 5/2006 | Jeon et al. |
| 2006/0096333 | A1 | | 5/2006 | Park et al. |
| 2006/0101586 | A1 | | 5/2006 | Park et al. |
| 2006/0101588 | A1 | | 5/2006 | Park et al. |
| 2006/0101867 | A1 | | 5/2006 | Kleker |
| 2006/0107468 | A1 | | 5/2006 | Urbanet et al. |
| 2006/0112585 | A1 | | 6/2006 | Choi et al. |
| 2006/0117596 | A1 | | 6/2006 | Kim et al. |
| 2006/0130354 | A1 | | 6/2006 | Choi et al. |
| 2006/0137105 | A1 | | 6/2006 | Hong et al. |
| 2006/0137107 | A1 | | 6/2006 | Lee et al. |
| 2006/0150689 | A1 | | 7/2006 | Kim et al. |
| 2006/0151005 | A1 | | 7/2006 | Kim et al. |
| 2006/0151009 | A1 | | 7/2006 | Kim et al. |
| 2006/0191077 | A1 | | 8/2006 | Oh et al. |
| 2006/0191078 | A1 | | 8/2006 | Kim et al. |

| | | | |
|---|---|---|---|
| 2006/0277690 | A1 | 12/2006 | Pyo et al. |
| 2007/0006484 | A1 | 1/2007 | Moschuetz et al. |
| 2007/0028398 | A1 | 2/2007 | Kwon et al. |
| 2007/0084000 | A1 | 4/2007 | Bernardino et al. |
| 2007/0101773 | A1 | 5/2007 | Park et al. |
| 2007/0107472 | A1 | 5/2007 | Kim et al. |
| 2007/0107884 | A1 | 5/2007 | Sirkar et al. |
| 2007/0125133 | A1 | 6/2007 | Oh et al. |
| 2007/0130697 | A1 | 6/2007 | Oh et al. |
| 2007/0136956 | A1 | 6/2007 | Kim et al. |
| 2007/0137262 | A1 | 6/2007 | Kim et al. |
| 2007/0169279 | A1 | 7/2007 | Park et al. |
| 2007/0169280 | A1 | 7/2007 | Kim et al. |
| 2007/0169282 | A1 | 7/2007 | Kim |
| 2007/0169521 | A1 | 7/2007 | Kim et al. |
| 2007/0180628 | A1 | 8/2007 | Ahn |
| 2007/0186591 | A1 | 8/2007 | Kim et al. |
| 2007/0186592 | A1 | 8/2007 | Kim et al. |
| 2007/0186593 | A1 | 8/2007 | Ahn |
| 2007/0199353 | A1 | 8/2007 | Woo et al. |
| 2007/0240458 | A1 | 10/2007 | Kim et al. |
| 2007/0283505 | A1 | 12/2007 | Wong et al. |
| 2007/0283508 | A1 | 12/2007 | Wong et al. |
| 2007/0283509 | A1 | 12/2007 | Wong et al. |
| 2007/0283728 | A1 | 12/2007 | Wong et al. |
| 2008/0006063 | A1 | 1/2008 | Ahn et al. |
| 2008/0019864 | A1 | 1/2008 | Savage et al. |
| 2008/0028801 | A1 | 2/2008 | Czyzewski et al. |
| 2008/0115740 | A1 | 5/2008 | You |
| 2009/0056034 | A1 | 3/2009 | Herkle et al. |
| 2009/0056036 | A1 | 3/2009 | Herkle et al. |
| 2009/0056762 | A1 | 3/2009 | Pinkowski et al. |

FOREIGN PATENT DOCUMENTS

| | | | |
|---|---|---|---|
| CN | 1664222 | | 9/2005 |
| CN | 1962988 | A | 5/2007 |
| CN | 1962998 | A | 5/2007 |
| CN | 1965123 | | 5/2007 |
| CN | 101003939 | A | 7/2007 |
| CN | 101008148 | A | 8/2007 |
| CN | 101024915 | A | 8/2007 |
| DE | 12203 | | 2/1881 |
| DE | 42920 | | 4/1888 |
| DE | 69929 | | 8/1893 |
| DE | 132104 | | 7/1902 |
| DE | 176355 | | 10/1906 |
| DE | 243328 | | 2/1912 |
| DE | 283533 | | 4/1915 |
| DE | 317887 | | 1/1920 |
| DE | 427025 | | 3/1926 |
| DE | 435088 | | 10/1926 |
| DE | 479594 | | 7/1929 |
| DE | 668963 | | 12/1938 |
| DE | 853433 | | 10/1952 |
| DE | 894685 | | 10/1953 |
| DE | 1847016 | | 2/1962 |
| DE | 1873622 | | 6/1963 |
| DE | 2202345 | | 8/1973 |
| DE | 2226373 | | 12/1973 |
| DE | 2245532 | | 3/1974 |
| DE | 7340082 | | 5/1975 |
| DE | 2410107 | | 9/1975 |
| DE | 2533759 | | 2/1977 |
| DE | 3103529 | A1 | 8/1982 |
| DE | 3139466 | A1 | 4/1983 |
| DE | 3408136 | | 9/1985 |
| DE | 3501008 | | 7/1986 |
| DE | 3627988 | | 4/1987 |
| DE | 8703344 | | 8/1988 |
| DE | 4116673 | A1 | 11/1992 |
| DE | 4225847 | | 2/1994 |
| DE | 4413213 | | 10/1995 |
| DE | 4443338 | | 6/1996 |
| DE | 29707168 | | 7/1997 |
| DE | 19730422 | A1 | 1/1999 |
| DE | 19736794 | A1 | 2/1999 |
| DE | 19742282 | | 2/1999 |
| DE | 19743508 | | 4/1999 |
| DE | 19751028 | | 5/1999 |
| DE | 19903951 | | 8/2000 |
| DE | 10028944 | | 12/2001 |
| DE | 10035904 | | 1/2002 |
| DE | 10039904 | | 2/2002 |
| DE | 10043165 | | 2/2002 |
| DE | 10312163 | | 11/2003 |
| DE | 10260163 | A1 | 7/2004 |
| DE | 102005051721 | | 5/2007 |
| DE | 102005051721 | A1 | 5/2007 |
| DE | 102007023020 | B3 | 5/2008 |
| EP | 0043122 | | 1/1982 |
| EP | 0132884 | | 2/1985 |
| EP | 0135484 | A2 | 3/1985 |
| EP | 0217981 | | 4/1987 |
| EP | 0222264 | | 5/1987 |
| EP | 0280782 | | 9/1988 |
| EP | 0284554 | | 9/1988 |
| EP | 0287990 | | 10/1988 |
| EP | 0302125 | | 8/1989 |
| EP | 363708 | | 4/1990 |
| EP | 0383327 | | 8/1990 |
| EP | 0404253 | A1 | 12/1990 |
| EP | 0511525 | | 11/1992 |
| EP | 0574341 | A1 | 12/1993 |
| EP | 0582092 | A1 | 2/1994 |
| EP | 0638684 | | 2/1995 |
| EP | 0672377 | | 9/1995 |
| EP | 0726349 | A2 | 8/1996 |
| EP | 0768059 | | 4/1997 |
| EP | 0785303 | | 7/1997 |
| EP | 0808936 | | 11/1997 |
| EP | 0821096 | | 1/1998 |
| EP | 0839943 | A1 | 5/1998 |
| EP | 0816550 | | 7/1998 |
| EP | 1163387 | | 12/2001 |
| EP | 1275767 | | 1/2003 |
| EP | 1351016 | | 10/2003 |
| EP | 1411163 | | 4/2004 |
| EP | 1437547 | | 7/2004 |
| EP | 1441059 | | 7/2004 |
| EP | 1441175 | | 7/2004 |
| EP | 1464750 | | 10/2004 |
| EP | 1464751 | | 10/2004 |
| EP | 1469120 | | 10/2004 |
| EP | 1505193 | A2 | 2/2005 |
| EP | 1507028 | | 2/2005 |
| EP | 1507029 | | 2/2005 |
| EP | 1507030 | | 2/2005 |
| EP | 1507031 | | 2/2005 |
| EP | 1507032 | | 2/2005 |
| EP | 1507033 | | 2/2005 |
| EP | 1529875 | | 5/2005 |
| EP | 1544345 | | 6/2005 |
| EP | 1548175 | | 6/2005 |
| EP | 1550760 | | 7/2005 |
| EP | 1555338 | | 7/2005 |
| EP | 1555340 | | 7/2005 |
| EP | 1561853 | | 8/2005 |
| EP | 1584728 | | 10/2005 |
| EP | 1619284 | A1 | 1/2006 |
| EP | 1655408 | A1 | 5/2006 |
| EP | 1659205 | A2 | 5/2006 |
| EP | 1666655 | A2 | 6/2006 |
| EP | 1681384 | A1 | 7/2006 |
| EP | 1696066 | A2 | 8/2006 |
| EP | 1731840 | | 12/2006 |
| EP | 1746197 | A2 | 1/2007 |
| EP | 1783262 | A2 | 5/2007 |
| EP | 1555339 | | 8/2007 |
| EP | 1813704 | A1 | 8/2007 |
| EP | 1813709 | A2 | 8/2007 |
| EP | 1865099 | A1 | 12/2007 |
| EP | 1865101 | A1 | 12/2007 |
| EP | 1889966 | A2 | 2/2008 |
| EP | 1936023 | A1 | 6/2008 |
| FR | 2306400 | | 10/1976 |
| FR | 2525645 | A1 | 10/1983 |

| | | | |
|---|---|---|---|
| FR | 2581442 | | 11/1986 |
| FR | 2688807 | A1 | 9/1993 |
| GB | 21286 | | 8/1898 |
| GB | 10423 | | 11/1909 |
| GB | 21024 | | 2/1910 |
| GB | 191010567 | A | 4/1911 |
| GB | 191010792 | A | 4/1911 |
| GB | 191022943 | A | 8/1911 |
| GB | 191024005 | A | 10/1911 |
| GB | 191103554 | A | 12/1911 |
| GB | 102466 | A | 12/1916 |
| GB | 285384 | A | 11/1928 |
| GB | 397236 | | 8/1933 |
| GB | 514440 | A | 11/1939 |
| GB | 685813 | | 1/1953 |
| GB | 799788 | | 8/1958 |
| GB | 835250 | | 5/1960 |
| GB | 881083 | | 11/1961 |
| GB | 889500 | A | 2/1962 |
| GB | 1155268 | | 6/1969 |
| GB | 1331623 | | 9/1973 |
| GB | 1352955 | | 5/1974 |
| GB | 1366852 | A | 9/1974 |
| GB | 2219603 | A | 12/1989 |
| GB | 2309071 | | 7/1997 |
| GB | 2348213 | | 9/2000 |
| JP | 35021275 | | 8/1950 |
| JP | 36023044 | | 9/1960 |
| JP | 36000067 | | 7/1961 |
| JP | 52146973 | | 12/1977 |
| JP | 54068072 | A | 5/1979 |
| JP | 57094480 | | 6/1982 |
| JP | 57032858 | | 7/1982 |
| JP | 60138399 | | 7/1985 |
| JP | 61128995 | | 6/1986 |
| JP | 62066891 | | 3/1987 |
| JP | 2049700 | | 2/1990 |
| JP | 02161997 | | 6/1990 |
| JP | 02026465 | | 7/1990 |
| JP | 02198595 | | 8/1990 |
| JP | 2239894 | | 9/1990 |
| JP | 2242088 | | 9/1990 |
| JP | 02267402 | | 11/1990 |
| JP | 03025748 | | 6/1991 |
| JP | 3137401 | | 6/1991 |
| JP | 04158896 | | 6/1992 |
| JP | 4158896 | A | 6/1992 |
| JP | 05023493 | | 2/1993 |
| JP | 05115672 | A | 5/1993 |
| JP | 05146583 | | 6/1993 |
| JP | 05269294 | | 10/1993 |
| JP | 5346485 | | 12/1993 |
| JP | 06123360 | | 5/1994 |
| JP | 08261689 | | 10/1996 |
| JP | 9133305 | | 5/1997 |
| JP | 10235088 | A | 9/1998 |
| JP | 11047488 | | 2/1999 |
| JP | 11164979 | | 6/1999 |
| JP | 11164980 | | 6/1999 |
| JP | 11226290 | | 8/1999 |
| JP | 2000176192 | | 6/2000 |
| JP | 2003019382 | | 1/2003 |
| JP | 2003093775 | | 4/2003 |
| JP | 2003311068 | | 11/2003 |
| JP | 2003311084 | | 11/2003 |
| JP | 2003320324 | | 11/2003 |
| JP | 2003326077 | | 11/2003 |
| JP | 2004061011 | | 2/2004 |
| JP | 2004121666 | | 4/2004 |
| JP | 2004167131 | | 6/2004 |
| JP | 2004298614 | | 10/2004 |
| JP | 2004298616 | | 10/2004 |
| JP | 2004313793 | | 11/2004 |
| JP | 2005058740 | | 3/2005 |
| JP | 2005058741 | | 3/2005 |
| JP | 2005177440 | | 7/2005 |
| JP | 2005177445 | | 7/2005 |
| JP | 2005177450 | | 7/2005 |
| JP | 2005192997 | | 7/2005 |
| JP | 2005193003 | | 7/2005 |
| JP | 2006109886 | | 4/2006 |
| JP | 2006130295 | | 5/2006 |
| KR | 9319820 | | 9/1993 |
| KR | 1019950018856 | | 7/1995 |
| KR | 1019970011098 | | 3/1997 |
| KR | 1019970070295 | | 11/1997 |
| KR | 2019970039170 | | 7/1998 |
| KR | 200128631 | | 8/1998 |
| KR | 100146947 | | 10/1998 |
| KR | 20010015043 | | 2/2001 |
| KR | 10220010010111 | | 2/2001 |
| KR | 20040085509 | A | 10/2004 |
| KR | 20050017481 | | 2/2005 |
| KR | 20060031165 | | 4/2006 |
| WO | 9214954 | | 9/1992 |
| WO | 9307798 | A1 | 4/1993 |
| WO | 9319237 | A1 | 9/1993 |
| WO | 9715709 | | 5/1997 |
| WO | 9803175 | | 1/1998 |
| WO | 0111134 | | 2/2001 |
| WO | 0174129 | A2 | 10/2001 |
| WO | 03012185 | | 2/2003 |
| WO | 03012185 | A2 | 2/2003 |
| WO | 03057966 | | 7/2003 |
| WO | 2004059070 | | 7/2004 |
| WO | 2004091359 | A2 | 10/2004 |
| WO | 2005001189 | A1 | 1/2005 |
| WO | 2005018837 | A1 | 3/2005 |
| WO | 2005115095 | | 12/2005 |
| WO | 2006001612 | | 1/2006 |
| WO | 2006009364 | A1 | 1/2006 |
| WO | 2006070317 | A1 | 7/2006 |
| WO | 2006090973 | | 8/2006 |
| WO | 2006091054 | | 8/2006 |
| WO | 2006091057 | A1 | 8/2006 |
| WO | 2006/101377 | A1 | 9/2006 |
| WO | 2006098571 | | 9/2006 |
| WO | 2006098572 | | 9/2006 |
| WO | 2006098573 | | 9/2006 |
| WO | 2006101304 | | 9/2006 |
| WO | 2006101312 | | 9/2006 |
| WO | 2006101336 | | 9/2006 |
| WO | 2006101345 | | 9/2006 |
| WO | 2006101358 | | 9/2006 |
| WO | 2006101360 | | 9/2006 |
| WO | 2006101361 | | 9/2006 |
| WO | 2006101362 | | 9/2006 |
| WO | 2006101363 | | 9/2006 |
| WO | 2006101365 | | 9/2006 |
| WO | 2006101372 | | 9/2006 |
| WO | 2006101376 | | 9/2006 |
| WO | 2006101377 | | 9/2006 |
| WO | 2006104310 | | 10/2006 |
| WO | 2006112611 | | 10/2006 |
| WO | 2006126778 | A1 | 11/2006 |
| WO | 2006126779 | A1 | 11/2006 |
| WO | 2006126799 | A2 | 11/2006 |
| WO | 2006126803 | A2 | 11/2006 |
| WO | 2006126804 | A2 | 11/2006 |
| WO | 2006126810 | A2 | 11/2006 |
| WO | 2006126811 | A2 | 11/2006 |
| WO | 2006126813 | A2 | 11/2006 |
| WO | 2006126815 | A2 | 11/2006 |
| WO | 2006129912 | A1 | 12/2006 |
| WO | 2006129913 | A1 | 12/2006 |
| WO | 2006129915 | A1 | 12/2006 |
| WO | 2006129916 | A1 | 12/2006 |
| WO | 2007004785 | A1 | 1/2007 |
| WO | 2007007241 | A1 | 1/2007 |
| WO | 2007010327 | A1 | 1/2007 |
| WO | 2007024050 | A1 | 3/2007 |
| WO | 2007024056 | A1 | 3/2007 |
| WO | 2007024057 | A1 | 3/2007 |
| WO | 2007026989 | A1 | 3/2007 |
| WO | 2007026990 | A1 | 3/2007 |
| WO | 2007055475 | A1 | 5/2007 |
| WO | 2007055510 | A1 | 5/2007 |
| WO | 2007058477 | A1 | 5/2007 |

| | | | |
|---|---|---|---|
| WO | 2007073012 | A1 | 6/2007 |
| WO | 2007073013 | A1 | 6/2007 |
| WO | 2007081069 | A1 | 7/2007 |
| WO | 2007086672 | A1 | 8/2007 |
| WO | 2007116255 | A1 | 10/2007 |
| WO | 2007145448 | A2 | 12/2007 |
| WO | 2008004801 | A2 | 1/2008 |

OTHER PUBLICATIONS

V-ZUG Ltd Washing Machine Adora SL; User Manual; V-ZUG AG, CH-6301 Zug, 2004; V-ZUG Ltd Industriestrasse 66, 6301 Zug. Tel 041 767 67 67.

* cited by examiner

FABRIC TREATMENT APPLIANCE WITH STEAM GENERATOR HAVING A VARIABLE THERMAL OUTPUT

BACKGROUND OF THE INVENTION

Some fabric treatment appliances, such as a washing machine, a clothes dryer, and a fabric refreshing or revitalizing machine, use steam generators for various reasons. The steam from the steam generator may be used to, for example, heat water, heat a load of fabric items and any water absorbed by the fabric items, dewrinkle fabric items, remove odors from fabric items, sanitize the fabric items, and sanitize components of the fabric treatment appliance.

Water from a water supply coupled with the steam generator typically provides water to the steam generator for conversion to steam. The water supply fills a steam generation chamber of the steam generator with water, and a heating element of the steam generator is activated to heat the water present in the steam generation chamber to generate steam. Steam generated in the steam generation chamber commonly flows from the steam generation chamber to a fabric treatment chamber via a steam supply conduit attached to the steam generator.

One problem associated with steam generators, especially in-line or flow-through steam generators, is that the heating element distributes heat in an inefficient manner. The heating element wraps around the steam generator in a manner providing, by conduction through the steam generator, substantially uniform thermal output into the steam generation chamber. For example, a standard in-line steam generator has a heating element formed from a resistive wire that is wrapped around the steam generation chamber. The steam generation chamber is often filled with an operating volume of water less than the total capacity of the steam generation chamber to provide for faster steam generation times and to provide room for expansion and boiling water. The operation volume of water results in an operational water level within the steam generation chamber. Air fills the steam generation chamber above the operational water level. However, the heating element is wrapped around the portion of the steam chamber containing both water and air. As the air is not a good conductor of heat, the portion of the heating element below the water level will more efficiently conduct heat into the water than the portion of the heating element above the water level.

In addition, inefficient heating of the steam generator can increase the buildup of scale inside the steam generation chamber. The temperature of the water in the steam generation chamber is limited, as it will eventually change phase to steam when it receives enough thermal output. The temperature of the steam, air, and vapor, however, is not limited. The upper portion of the steam generation chamber, therefore, has a tendency to reach higher temperatures. Higher temperatures convert soft calcium deposits in the steam generation chamber to hard calcium, which is not easily removed by the movement of water therein. If flow out of the steam generator or flow through the steam supply conduit becomes impaired due to the buildup of scale, the steam generator will malfunction and possibly damage the fabric treatment appliance.

SUMMARY OF THE INVENTION

A steam generator according to one embodiment of the invention includes a steam generation chamber for converting the water to steam, and a heating element thermally coupled with the steam generation chamber and having a first portion below an operational water level of the steam generation chamber and a second portion above the operational water level, with the first portion having a greater thermal output than the second portion.

DESCRIPTION OF EMBODIMENTS OF THE INVENTION

Figure 1:
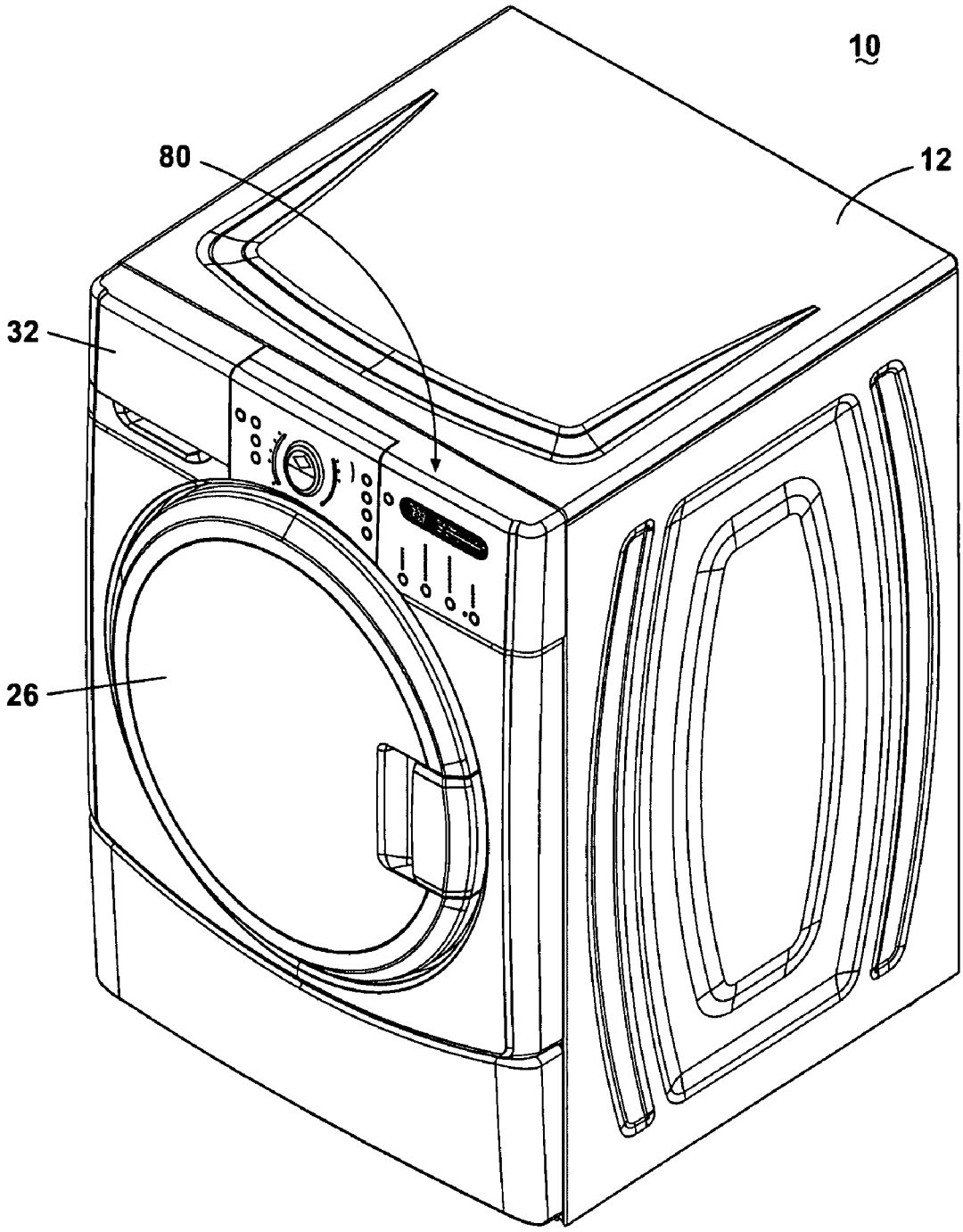
FIG. 1 is a perspective view of an exemplary fabric treatment appliance in the form of a washing machine.

Referring now to the figures, FIG. 1 is a schematic view of an exemplary fabric treatment appliance in the form of a washing machine 10 according to one embodiment of the invention. The fabric treatment appliance may be any machine that treats fabrics, and examples of the fabric treatment appliance may include, but are not limited to, a washing machine, including top-loading, front-loading, vertical axis, and horizontal axis washing machines; a dryer, such as a tumble dryer or a stationary dryer, including top-loading dryers and front-loading dryers; a combination washing machine and dryer; a tumbling or stationary refreshing/revitalizing machine; an extractor; a non-aqueous washing apparatus; and a revitalizing machine. For illustrative purposes, the invention will be described with respect to a washing machine with the fabric being a clothes load, with it being understood that the invention may be adapted for use with any type of fabric treatment appliance for treating fabric and to other appliances, such as dishwashers, irons, and cooking appliances, including ovens, food steamers, and microwave ovens, employing a steam generator.

Figure 2:
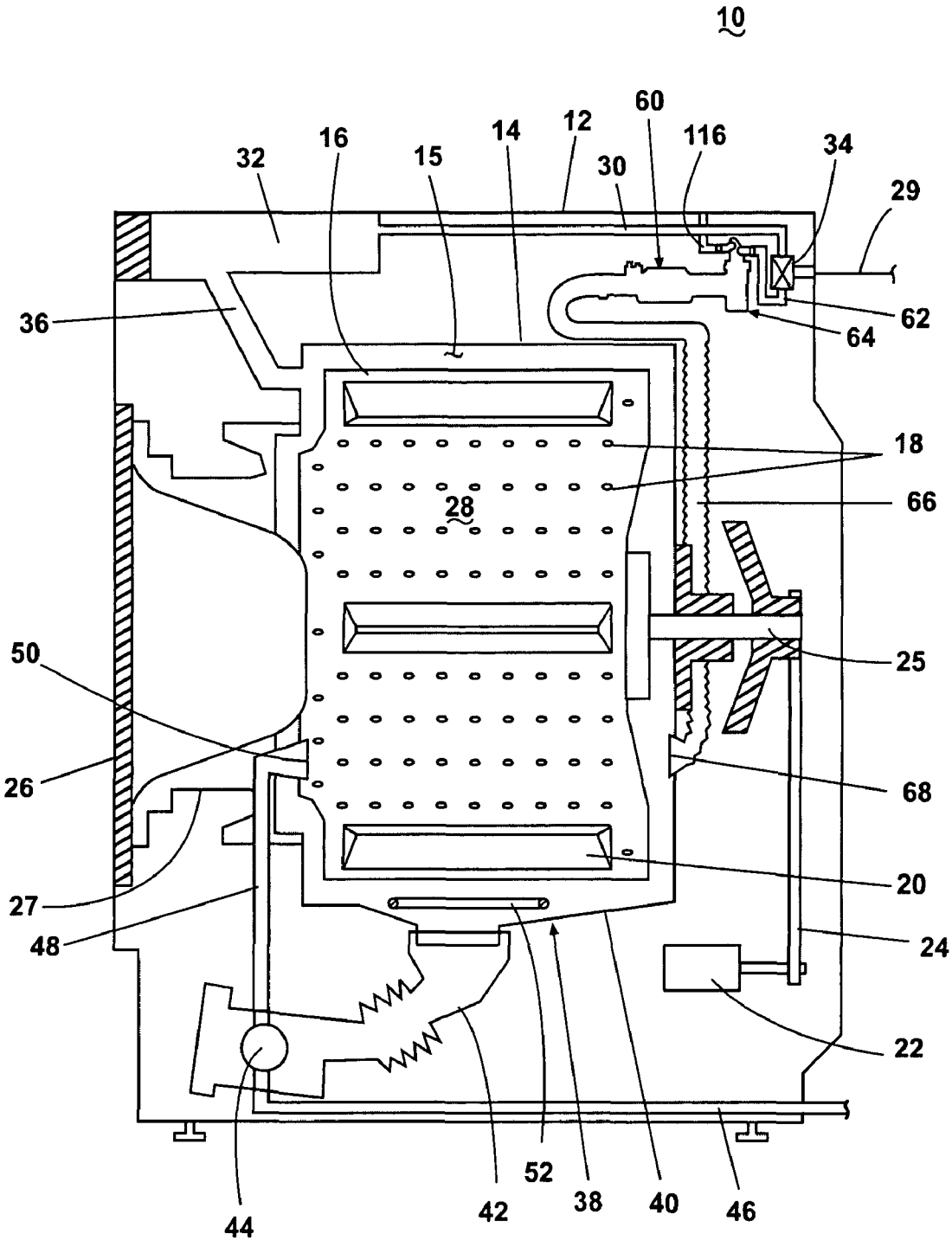
FIG. 2 is a schematic view of the fabric treatment appliance of FIG. 1.

FIG. 2 provides a schematic view of the fabric treatment appliance of FIG. 1. The washing machine 10 of the illustrated embodiment may include a cabinet 12 that houses a stationary tub 14, which defines an interior chamber 15. A rotatable drum 16 mounted within the interior chamber 15 of the tub 14 may include a plurality of perforations 18, and liquid may flow between the tub 14 and the drum 16 through the perforations 18. The drum 16 may further include a plurality of baffles 20 disposed on an inner surface of the drum 16 to lift fabric items contained in the drum 16 while the drum 16 rotates, as is well known in the washing machine art. A motor 22 coupled to the drum 16 through a belt 24 and a drive shaft 25 may rotate the drum 16. Alternately, the motor 22 may be directly coupled with the drive shaft 25 as is known in the art. Both the tub 14 and the drum 16 may be selectively closed by a door 26. A bellows 27 couples an open face of the tub 14 with the cabinet 12, and the door 26 seals against the bellows 27 when the door 26 closes the tub 14. The drum 16 may define a cleaning chamber 28 for receiving fabric items to be cleaned.

The tub 14 and/or the drum 16 may be considered a receptacle, and the receptacle may define a treatment chamber for receiving fabric items to be treated. While the illustrated washing machine 10 includes both the tub 14 and the drum 16, it is within the scope of the invention for the fabric treatment appliance to include only one receptacle, with the receptacle defining the treatment chamber for receiving the fabric items to be treated.

Washing machines are typically categorized as either a vertical axis washing machine or a horizontal axis washing machine. As used herein, the "vertical axis" washing machine refers to a washing machine having a rotatable drum that rotates about a generally vertical axis relative to a surface that supports the washing machine. Typically, the drum is perforate or imperforate and holds fabric items and a fabric moving element, such as an agitator, impeller, nutator, and the like, that induces movement of the fabric items to impart mechanical energy to the fabric articles for cleaning action. However, the rotational axis need not be vertical. The drum can rotate about an axis inclined relative to the vertical axis. As used herein, the "horizontal axis" washing machine refers to a washing machine having a rotatable drum that rotates about a generally horizontal axis relative to a surface that supports the washing machine. The drum may be perforated or imperforate, holds fabric items, and typically washes the fabric items by the fabric items rubbing against one another and/or hitting the surface of the drum as the drum rotates. In horizontal axis washing machines, the clothes are lifted by the rotating drum and then fall in response to gravity to form a tumbling action that imparts the mechanical energy to the fabric articles. In some horizontal axis washing machines, the drum rotates about a horizontal axis generally parallel to a surface that supports the washing machine. However, the rotational axis need not be horizontal. The drum can rotate about an axis inclined relative to the horizontal axis, with fifteen degrees of inclination being one example of inclination.

Vertical axis and horizontal axis machines are best differentiated by the manner in which they impart mechanical energy to the fabric articles. In vertical axis machines, the fabric moving element moves within a drum to impart mechanical energy directly to the clothes or indirectly through wash liquid in the drum. The clothes mover is typically moved in a reciprocating rotational movement. In horizontal axis machines mechanical energy is imparted to the clothes by the tumbling action formed by the repeated lifting and dropping of the clothes, which is typically implemented by the rotating drum. The illustrated exemplary washing machine of FIGS. 1 and 2 is a horizontal axis washing machine.

With continued reference to FIG. 2, the motor 22 may rotate the drum 16 at various speeds in opposite rotational directions. In particular, the motor 22 may rotate the drum 16 at tumbling speeds wherein the fabric items in the drum 16 rotate with the drum 16 from a lowest location of the drum 16 towards a highest location of the drum 16, but fall back to the lowest location of the drum 16 before reaching the highest location of the drum 16. The rotation of the fabric items with the drum 16 may be facilitated by the baffles 20. Typically, the radial force applied to the fabric items at the tumbling speeds may be less than about 1 G. Alternatively, the motor 22 may rotate the drum 16 at spin speeds wherein the fabric items rotate with the drum 16 without falling. In the washing machine art, the spin speeds may also be referred to as satellizing speeds or sticking speeds. Typically, the force applied to the fabric items at the spin speeds may be greater than or about equal to 1 G. As used herein, "tumbling" of the drum 16 refers to rotating the drum at a tumble speed, "spinning" the drum 16 refers to rotating the drum 16 at a spin speed, and "rotating" of the drum 16 refers to rotating the drum 16 at any speed.

The washing machine 10 of FIG. 2 may further include a liquid supply and recirculation system. Liquid, such as water, may be supplied to the washing machine 10 from a water supply 29, such as a household water supply. A first supply conduit 30 may fluidly couple the water supply 29 to a detergent dispenser 32. An inlet valve 34 may control flow of the liquid from the water supply 29 and through the first supply conduit 30 to the detergent dispenser 32. The inlet valve 34 may be positioned in any suitable location between the water supply 29 and the detergent dispenser 32. A liquid conduit 36 may fluidly couple the detergent dispenser 32 with the tub 14. The liquid conduit 36 may couple with the tub 14 at any suitable location on the tub 14 and is shown as being coupled to a front wall of the tub 14 in FIG. 1 for exemplary purposes. The liquid that flows from the detergent dispenser 32 through the liquid conduit 36 to the tub 14 typically enters a space between the tub 14 and the drum 16 and may flow by gravity to a sump 38 formed in part by a lower portion 40 of the tub 14. The sump 38 may also be formed by a sump conduit 42 that may fluidly couple the lower portion 40 of the tub 14 to a pump 44. The pump 44 may direct fluid to a drain conduit 46, which may drain the liquid from the washing machine 10, or to a recirculation conduit 48, which may terminate at a recirculation inlet 50. The recirculation inlet 50 may direct the liquid from the recirculation conduit 48 into the drum 16. The recirculation inlet 50 may introduce the liquid into the drum 16 in any suitable manner, such as by spraying, dripping, or providing a steady flow of the liquid.

The exemplary washing machine 10 may further include a steam generation system. The steam generation system may include a steam generator 60 that may receive liquid from the water supply 29 through a second supply conduit 62, optionally via a reservoir 64. The inlet valve 34 may control flow of the liquid from the water supply 29 and through the second supply conduit 62 and the reservoir 64 to the steam generator 60. The inlet valve 34 may be positioned in any suitable location between the water supply 29 and the steam generator 60. A steam conduit 66 may fluidly couple the steam generator 60 to a steam inlet 68, which may introduce steam into the tub 14. The steam inlet 68 may couple with the tub 14 at any suitable location on the tub 14 and is shown as being coupled to a rear wall of the tub 14 in FIG. 2 for exemplary purposes. The steam that enters the tub 14 through the steam inlet 68 may subsequently enter the drum 16 through the perforations 18. Alternatively, the steam inlet 68 may be configured to introduce the steam directly into the drum 16. The steam inlet 68 may introduce the steam into the tub 14 in any suitable manner.

An optional sump heater 52 may be located in the sump 38. The sump heater 52 may be any type of heater and is illustrated as a resistive heating element for exemplary purposes. The sump heater 52 may be used alone or in combination with the steam generator 60 to add heat to the chamber 15. Typically, the sump heater 52 adds heat to the chamber 15 by heating water in the sump 38. The tub 14 may further include a temperature sensor 54, which may be located in the sump 38 or in another suitable location in the tub 14. The temperature sensor 54 may sense the temperature of water in the sump 38, if the sump 38 contains water, or a general temperature of the tub 14 or interior of the tub 14. The tub 14 may alternatively or additionally have a temperature sensor 56 located outside the sump 38 to sense a general temperature of the tub or interior of the tub 14. The temperature sensors 54, 56 may be any type of temperature sensors, which are well-known to one skilled in the art. Exemplary temperature sensors for use as the temperature sensors 54, 56 include thermistors, such as a negative temperature coefficient (NTC) thermistor.

The washing machine 10 may further include an exhaust conduit (not shown) that may direct steam that leaves the tub 14 externally of the washing machine 10. The exhaust conduit may be configured to exhaust the steam directly to the exterior of the washing machine 10. Alternatively, the exhaust conduit may be configured to direct the steam through a condenser prior to leaving the washing machine 10. Examples of exhaust systems are disclosed in the following patent applications, which are incorporated herein by reference in their entirety: U.S. patent application Ser. No. 11/464,506, titled "Fabric Treating Appliance Utilizing Steam," U.S. patent application Ser. No. 11/464,501, titled "A Steam Fabric Treatment Appliance with Exhaust," U.S. patent application Ser. No. 11/464,521, titled "Steam Fabric Treatment Appliance with Anti-Siphoning," and U.S. patent application Ser. No. 11/464,520, titled "Determining Fabric Temperature in a Fabric Treating Appliance," all filed Aug. 15, 2006.

The steam generator 60 may be any type of device that converts the liquid to steam. For example, the steam generator 60 may be a tank-type steam generator that stores a volume of liquid and heats the volume of liquid to convert the liquid to steam. Alternatively, the steam generator 60 may be an in-line steam generator that converts the liquid to steam as the liquid flows through the steam generator 60. As another alternative, the steam generator 60 may utilize the sump heater 52 or other heating device located in the sump 38 to heat liquid in the sump 38. The steam generator 60 may produce pressurized or non-pressurized steam.

Exemplary steam generators are disclosed in U.S. patent application Ser. No. 11/464,528, titled "Removal of Scale and Sludge in a Steam Generator of a Fabric Treatment Appliance," U.S. patent application Ser. No. 11/450,836, titled "Prevention of Scale and Sludge in a Steam Generator of a Fabric Treatment Appliance," and U.S. patent application Ser. No. 11/450,714, titled "Draining Liquid From a Steam Generator of a Fabric Treatment Appliance," all filed Jun. 9, 2006, in addition to U.S. patent application Ser. No. 11/464,509, titled "Water Supply Control for a Steam Generator of a Fabric Treatment Appliance," U.S. patent application Ser. No. 11/464,514, titled "Water Supply Control for a Steam Generator of a Fabric Treatment Appliance Using a Weight Sensor," and U.S. patent application Ser. No. 11/464,513, titled "Water Supply Control for a Steam Generator of a Fabric Treatment Appliance Using a Temperature Sensor," all filed Aug. 15, 2006, which are incorporated herein by reference in their entirety.

In addition to producing steam, the steam generator 60, whether an in-line steam generator, a tank-type steam generator, or any other type of steam generator, may heat water to a temperature below a steam transformation temperature, whereby the steam generator 60 produces heated water. The heated water may be delivered to the tub 14 and/or drum 16 from the steam generator 60. The heated water may be used alone or may optionally mix with cold or warm water in the tub 14 and/or drum 16. Using the steam generator 60 to produce heated water may be useful when the steam generator 60 couples only with a cold water source of the water supply 29. Optionally, the steam generator 60 may be employed to simultaneously supply steam and heated water to the tub 14 and/or drum 16.

The liquid supply and recirculation system and the steam generation system may differ from the configuration shown in FIG. 2, such as by inclusion of other valves, conduits, wash aid dispensers, and the like, to control the flow of liquid and steam through the washing machine 10 and for the introduction of more than one type of detergent/wash aid. For example, a valve may be located in the liquid conduit 36, in the recirculation conduit 48, and in the steam conduit 66. Furthermore, an additional conduit may be included to couple the water supply 29 directly to the tub 14 or the drum 16 so that the liquid provided to the tub 14 or the drum 16 does not have to pass through the detergent dispenser 32. Alternatively, the liquid may be provided to the tub 14 or the drum 16 through the steam generator 60 rather than through the detergent dispenser 32 or the additional conduit. As another example, the liquid conduit 36 may be configured to supply liquid directly into the drum 16, and the recirculation conduit 48 may be coupled to the liquid conduit 36 so that the recirculated liquid enters the tub 14 or the drum 16 at the same location where the liquid from the detergent dispenser 32 enters the tub 14 or the drum 16.

Other alternatives for the liquid supply and recirculation system are disclosed in U.S. patent application Ser. No. 11/450,636, titled "Method of Operating a Washing Machine Using Steam;" U.S. patent application Ser. No. 11/450,529, titled "Steam Washing Machine Operation Method Having Dual Speed Spin Pre-Wash;" and U.S. patent application Ser. No. 11/450,620, titled "Steam Washing Machine Operation Method Having Dry Spin Pre-Wash," all filed Jun. 9, 2006, which are incorporated herein by reference in their entirety.

Figure 3:
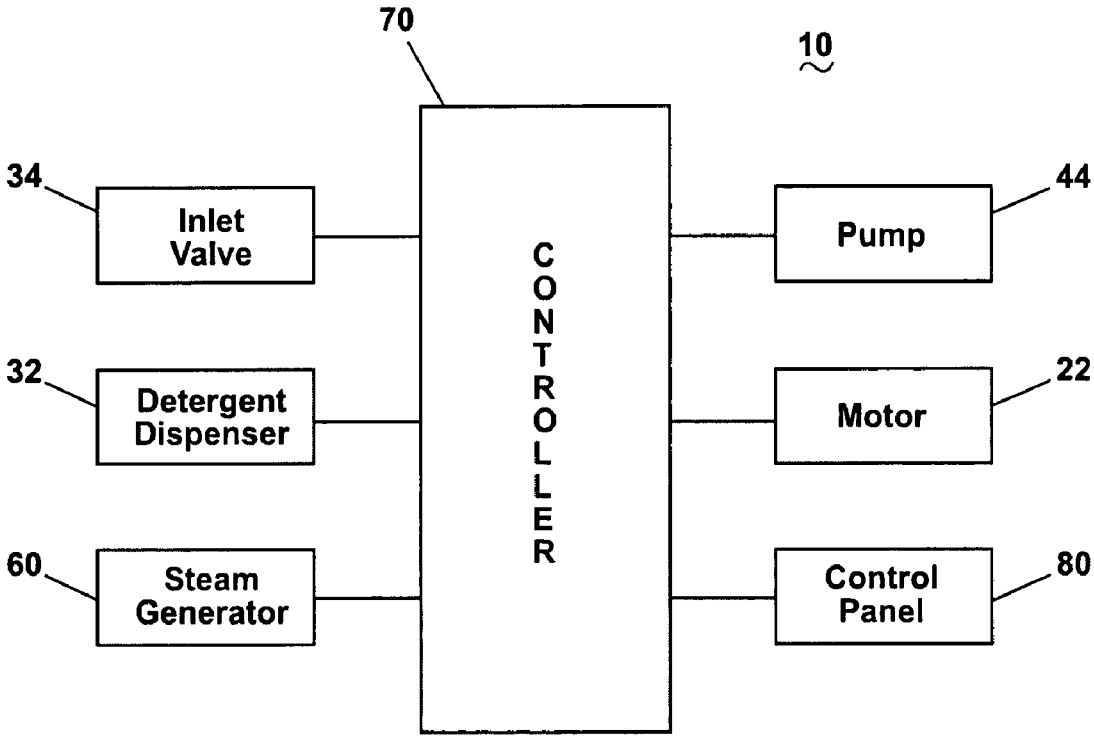
FIG. 3 is a schematic view of an exemplary control system of the fabric treatment appliance of FIG. 1.

Referring now to FIG. 3, which is a schematic view of an exemplary control system of the washing machine 10, the washing machine 10 may further include a controller 70 coupled to various working components of the washing machine 10, such as the pump 44, the motor 22, the inlet valve 34, the detergent dispenser 32, and the steam generator 60, to control the operation of the washing machine 10. If the optional sump heater 52 is used, the controller may also control the operation of the sump heater 52. The controller 70 may receive data from one or more of the working components or sensors, such as the temperature sensors 54, 56, and may provide commands, which can be based on the received data, to one or more of the working components to execute a desired operation of the washing machine 10. The commands may be data and/or an electrical signal without data. A control panel 80 may be coupled to the controller 70 and may provide for input/output to/from the controller 70. In other words, the control panel 80 may perform a user interface function through which a user may enter input related to the operation of the washing machine 10, such as selection and/or modification of an operation cycle of the washing machine 10, and receive output related to the operation of the washing machine 10.

Many known types of controllers may be used for the controller 70. The specific type of controller is not germane to the invention. It is contemplated that the controller is a microprocessor-based controller that implements control software and sends/receives one or more electrical signals to/from each of the various components (inlet valve 34, detergent dispenser 32, steam generator 60, pump 44, motor 22, control panel 80, and temperature sensors 54, 56) to effect the control software. As an example, proportional control (P), proportional integral control (PI), and proportional derivative control (PD), or a combination thereof, a proportional integral derivative control (PID control), may be used to control the various components.

Figure 4:
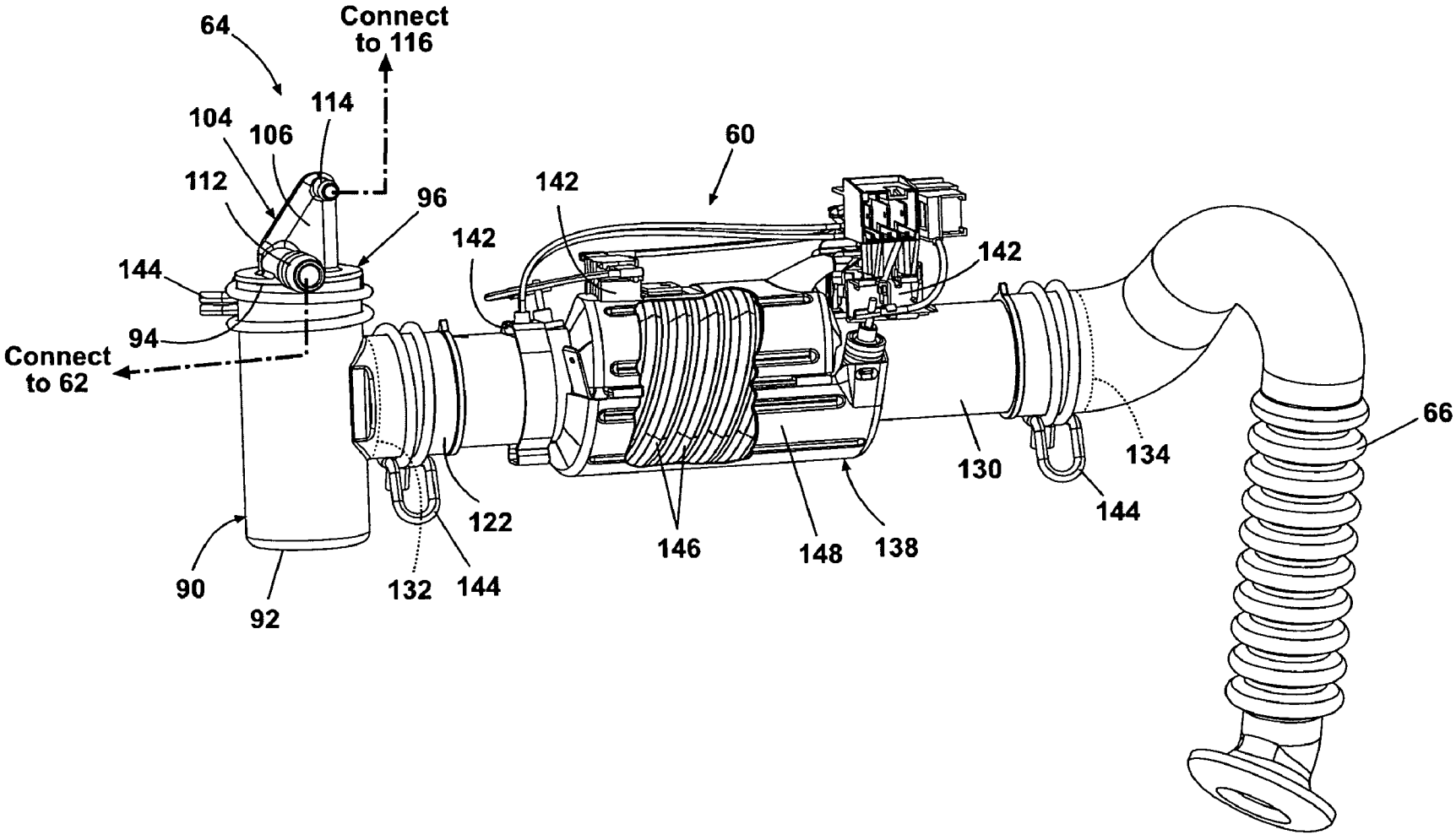
FIG. 4 is a perspective view of a steam generator, reservoir, and steam conduit from the fabric treatment appliance of FIG. 1, with the steam generator partially broken away to illustrate a heating element.

FIG. 4 provides a perspective view of the reservoir 64, the steam generator 60, and the steam conduit 66. In general, the reservoir 64 may be configured to receive water from the water supply 29, store a volume of water, and supply water to the steam generator 60. In the exemplary embodiment, the reservoir 64 may include an open-top tank 90 and a lid 92 removably closing the open top of the tank 90. The reservoir 64 may include a water supply conduit 94 for supplying water from the water supply 29 to the tank 90. In the illustrated embodiment, the water supply conduit 94 may extend through the lid 92 and include a water supply inlet connector 96 and a siphon break connector 98. The water supply inlet connector 96 may be coupled to the second water supply conduit 62 (FIG. 2) to receive water from the water supply 29 and provide the water to the water supply conduit 94. The siphon break connector 98 may be coupled to a siphon break conduit 100 (FIG. 2) to form a siphon break device. The siphon break conduit 100 may be coupled to atmosphere external to the washing machine 10. The water supply inlet connector 96, the siphon break connector 98, and the water supply conduit 94 may be in fluid communication with one another. The reservoir 64 may further include a steam generator connector 102 for coupling the tank 90 to the steam generator 60 and supplying water from the tank 90 to the steam generator 60. In the illustrated embodiment, the steam generator connector 102 may project laterally from the tank 90.

The steam generator 160 comprises a tube 130 about a portion of which is wrapped a heating element 146, which is illustrated as an electrically resistive heating element that conducts heat to the tube 130. A cover 148 encloses most of the heating element 146. In the illustrated embodiment, the tube has a circular cross-section. Alternatively, the tube 130 may have a cross-section of a different shape, such as triangular, square, or polygonal, for example.

Figure 5:
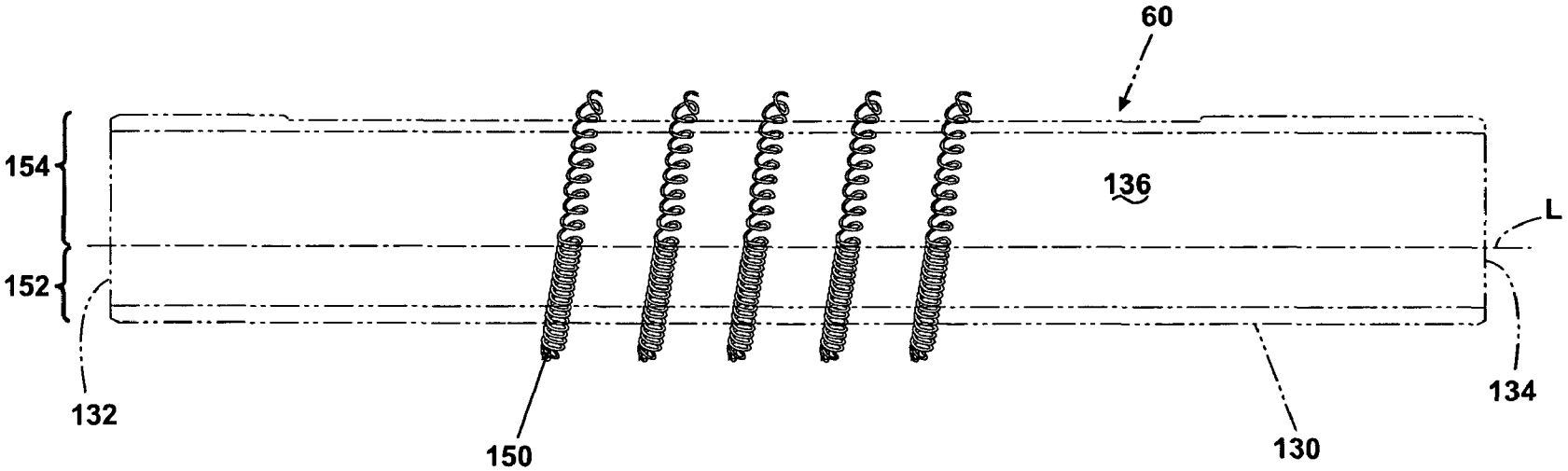
FIG. 5 is a schematic view of a first embodiment of a steam generator having a variable thermal output heating element according to the invention.

FIG. 5 illustrates a schematic view of the steam tube 130 and the heating element 146 of the steam generator 60 with the cover 148 removed for clarity. The heating element 146 comprises a variable-pitch, coiled wire 150, which is shown encapsulated in a protective coating in FIG. 4, but which has been removed for clarity in FIG. 5. The wire 150 wraps around the steam generation chamber 136 in a generally central location relative to first and second ends 132, 134. Each 360° portion of the wire 150 extending radially from the bottom of the steam tube 130 to the top of the steam tube and back to the bottom again forms a winding. The wire 150 has at least one winding and may have any number of additional windings. The variable pitch heating element 150 includes a first portion 152 below an operational water level L of the steam generation chamber 136 and a second portion 154 above the operational water level L. The wire coils in the first portion 152 of the variable pitch heating element 150 may have a smaller pitch, which is the axial spacing between adjacent coils of the wire, than the second portion 154 of the variable pitch heating element 150. The cross-sectional area of all of the coils of the variable pitch heating element 150 may be the same. In the illustrated embodiment, the coils all have a circular cross-section having the same diameter. Alternatively, the coils may have a cross-section of a different shape, such as triangular, square, or polygonal.

Due to the change in pitch between the first portion 152 and the second portion 154 of the variable pitch heating element 150, a greater total length of the wire forming the variable pitch heating element 150 may be located below the operational water level L in the first portion 152 than the total length of wire above the operational water level L. As the heat outputted by the heating element is the same for a given lineal portion of the wire, the greater the length of wire below the operational water level L results in the heating element 146 having a greater thermal output below the operation water level than above the water level L. Therefore, a greater portion of the total thermal output of the heating element 146 is directed to the portion of the steam generation chamber 136 below the water level L.

A numerical example may be helpful. Assuming the heating element is a 1000 watt heater when operating at design conditions, if 25% of the wire lies above the operational water level L and 75% of the wire lies below the operation water level L, then 250 watts of thermal output is directed into the tube 130 above the operational water level L and 750 watts of thermal output is directed into the tube below the operation water level L.

The variable pitch heating element 150 may be formed by winding a wire around a shaped former, such as a rod. The pitch may be changed by winding the wire with an increased spacing between adjacent coils along portions corresponding to the second portion 154 of the variable pitch heating element 150. Alternatively, the variable pitch heating element 150 may be formed by winding a wire around a shaped former to form a coil of uniform pitch and then slightly stretching the coiled wire along portions corresponding to the second portion 154 of the variable pitch heating element 150.

Figure 6:
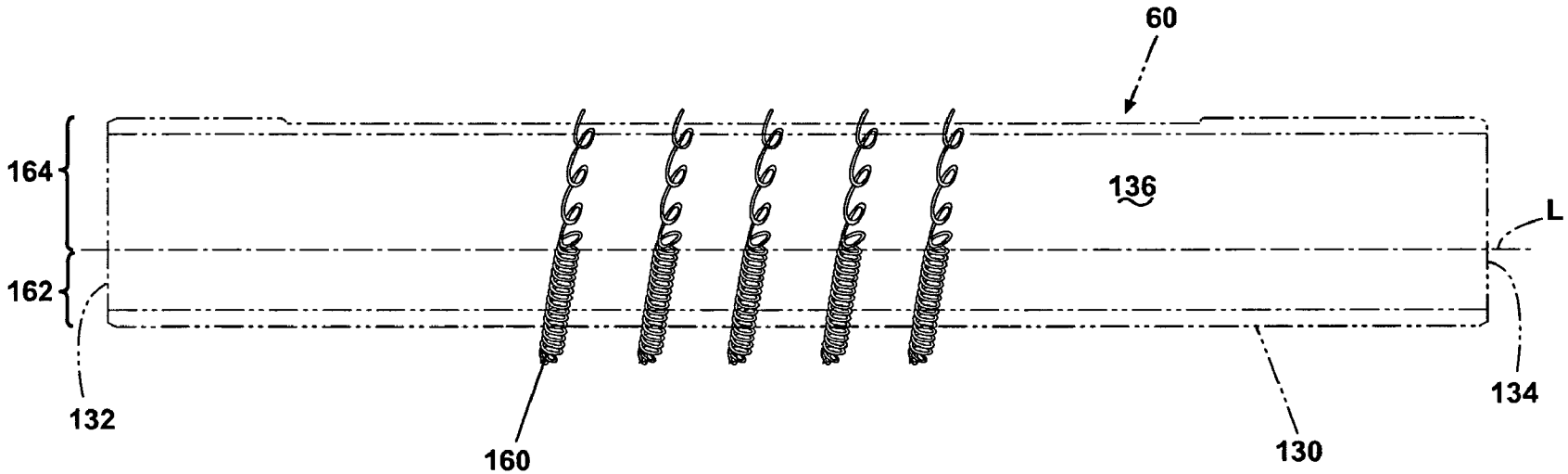
FIG. 6 is a schematic view of a second embodiment of a steam generator with a variable thermal output heating element according to the invention.

FIG. 6 illustrates a second embodiment of the steam generator 60 according to the invention and having the standard heating element 146 replaced by a stretched heating element 160. All of the other parts of the steam generator 60 are identical to those previously described. The stretched heating element 160 may be a coiled wire wrapped around the steam generation chamber 136 in a generally central location relative to the first and second ends 132, 134. The stretched heating element 160 includes a first portion 162 below an operational water level L of the steam generation chamber 136 and a second portion 164 above the operational water level L. The first portion 162 of the stretched heating element 160 may have a greater number of coils than the second portion of the stretched heating element 160. In the illustrated embodiment, the coils all have a generally circular cross-section. Alternatively, the coils could have a different shape, such as triangular, square, or polygonal.

The stretched heating element 160 may be formed by beginning with a coiled wire having generally similar coils with the same pitch. A portion of the coils are then pulled or stretched along a longitudinal axis to form a stretched portion, which becomes the second portion above the operation water level L. The longitudinal axis may be a central axis extending through the centers of the coils. In the illustrated embodiment, the longitudinal axis wraps around the tube 130. More specifically, the stretched heating element 160 may be formed by winding the wire around a shaped former, such as a rod. The wire may be wound so as to have a uniform pitch, and the portions of the coiled wire corresponding to the second portion 164 may then be axially over-stretched so as to reduce the number of coils in the second portion.

The stretched coils tend to have a smaller effective diameter and a much greater pitch than the non-stretched coils, resulting in fewer coils per unit length along the longitudinal axis of the heating element 160, which can also be characterized as less wire per unit length along the longitudinal axis. The reduction in coils and/or wire in the second portion as compared to the first portion results in the second portion having less thermal output than the first portion. Therefore a greater portion of the thermal output is located below the operational water level than above the operational water level.

Figure 7:
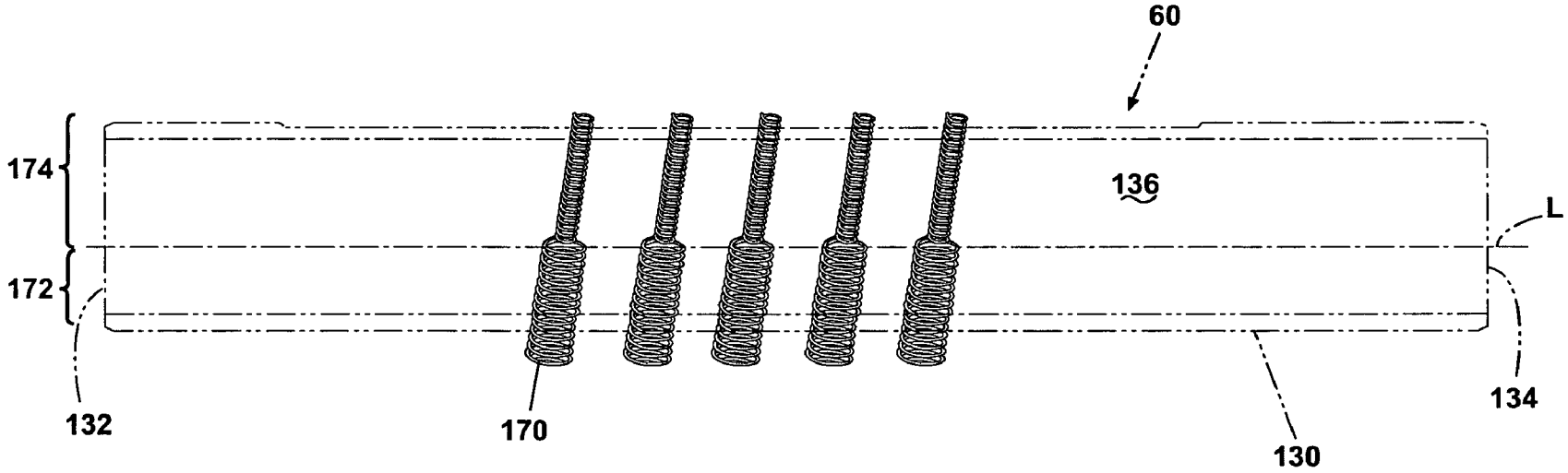
FIG. 7 is a schematic view of a third embodiment of a steam generator with a variable thermal output heating element according to the invention.

FIG. 7 illustrates a third embodiment of the steam generator 60 according to the invention having the standard heating element 146 replaced by a variable coil size heating element 170. All of the other parts of the steam generator 60 are identical to those previously described. The variable coil size heating element 170 may be a coiled wire wrapped around the steam generation chamber 136 in a generally central location relative to the first and second ends 132, 134. The variable coil size heating element 170 includes a first portion 172 below an operational water level L of the steam generation chamber 136 and a second portion 174 above the operational water level L. The variable coil size heating element 170 may have a uniform pitch. The cross-sectional area of the coils in the first portion 172 of the variable size area heating element 170 may be larger than the cross-sectional area of the coils in the second portion of the variable coil size heating element 170. In the illustrated embodiment, the coils of the variable coil size heating element 170 all have a generally circular cross-section. Alternatively, the coils could have a different shape, such as triangular, square, or polygonal.

Due to the change in the cross-sectional area between the coils in the first portion 172 and the coils in the second portion 174, a greater total length of the wire forming the variable coil size heating element 170 is located below the operational water level L in the first portion 172. Therefore a greater portion of the thermal output is located below the operational water level than above the operational water level.

The variable cross-sectional area heating element 170 may be formed by winding a portion of the wire corresponding to the first portion 172 around a first shaped former, such as a rod, having a first cross-sectional area. A remaining portion of the wire corresponding to the second portion 174 may then be wound around a second shaped former, such as a rod, having a second cross-sectional area smaller than the first cross-sectional area. Alternatively, a single shaped former having a plurality of sections corresponding to each of the first portion 172 and the second portion 174 with different cross-sectional areas may be used to form the variable coil size heating element 170.

Figure 8:
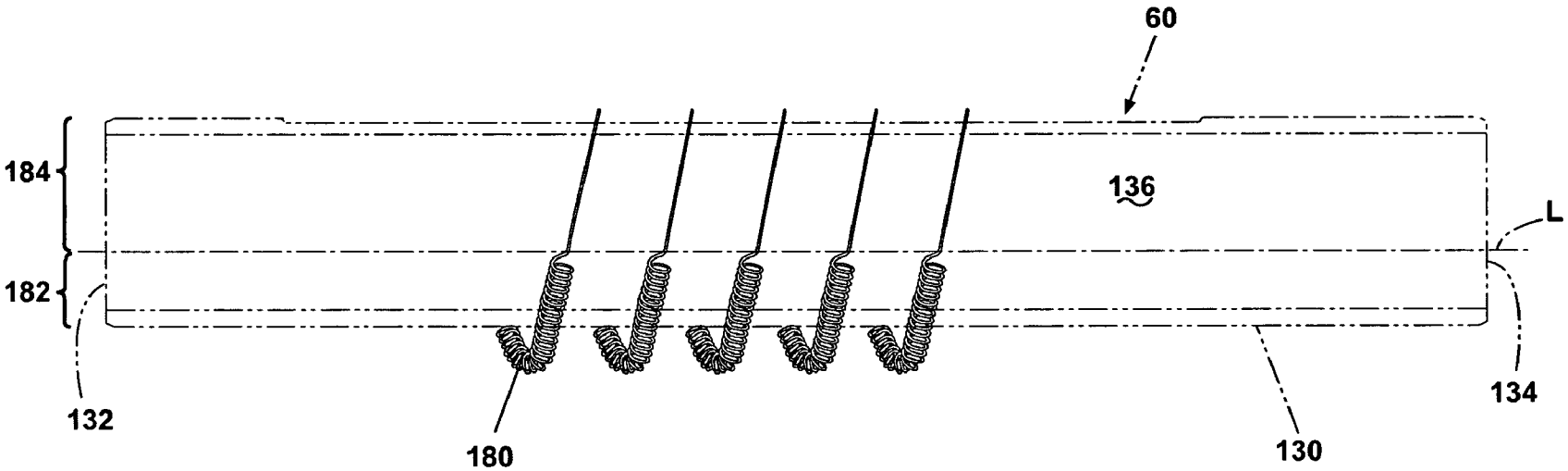
FIG. 8 is a schematic view of a fourth embodiment of a steam generator with a variable thermal output heating element according to the invention.

FIG. 8 illustrates a fourth embodiment of the steam generator 60 according to the invention having the standard heating element 146 replaced by a partially coiled heating element 180. All of the other parts of the steam generator 60 are identical to those previously described. The partially coiled heating element 180 is a coiled wire coiled around the steam generation chamber 136 in a generally central location relative to the first and second ends 132, 134. The partially coiled heating element 180 includes a first portion 182 below an operational water level L of the steam generation chamber 136 and a second portion 184 above the operational water level L. The first portion 182 of the partially coiled heating element 180 may be coiled while the second portion 184 of the partially coiled heating element 180 may be substantially straight. In the illustrated embodiment, the coils all have a generally circular cross-section. Alternatively, the coils could have a different shape, such as triangular, square, or polygonal. Due to the coils in the first portion 182, a greater total length of the wire forming the partially coiled heating element 180 is located below the operational water level L in the first portion 182. Therefore a greater portion of the thermal output is located below the operational water level than above the operational water level.

The partially coiled heating element 180 may be formed by winding a portion of the wire corresponding to the first portion 182 around a shaped former of a constant cross-sectional area, such as a rod, so that the coiled wire has a uniform pitch. The remaining wire corresponding to the second portion 184 is not coiled.

Figure 9:
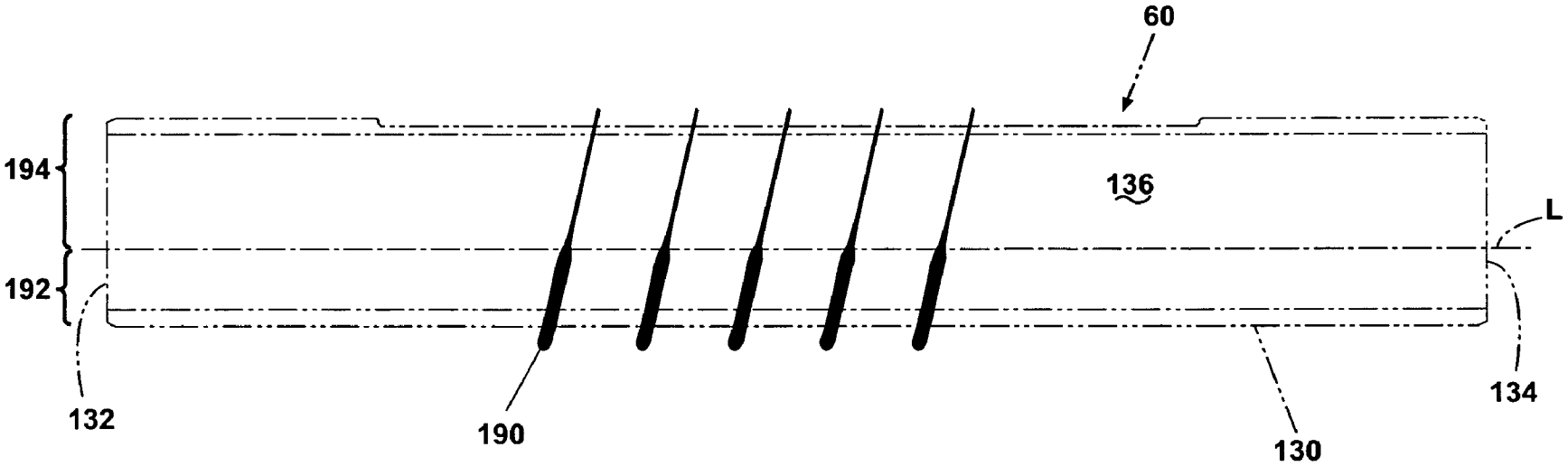
FIG. 9 is a schematic view of a fifth embodiment of a steam generator with a variable thermal output heating element according to the invention.
Figure 10:
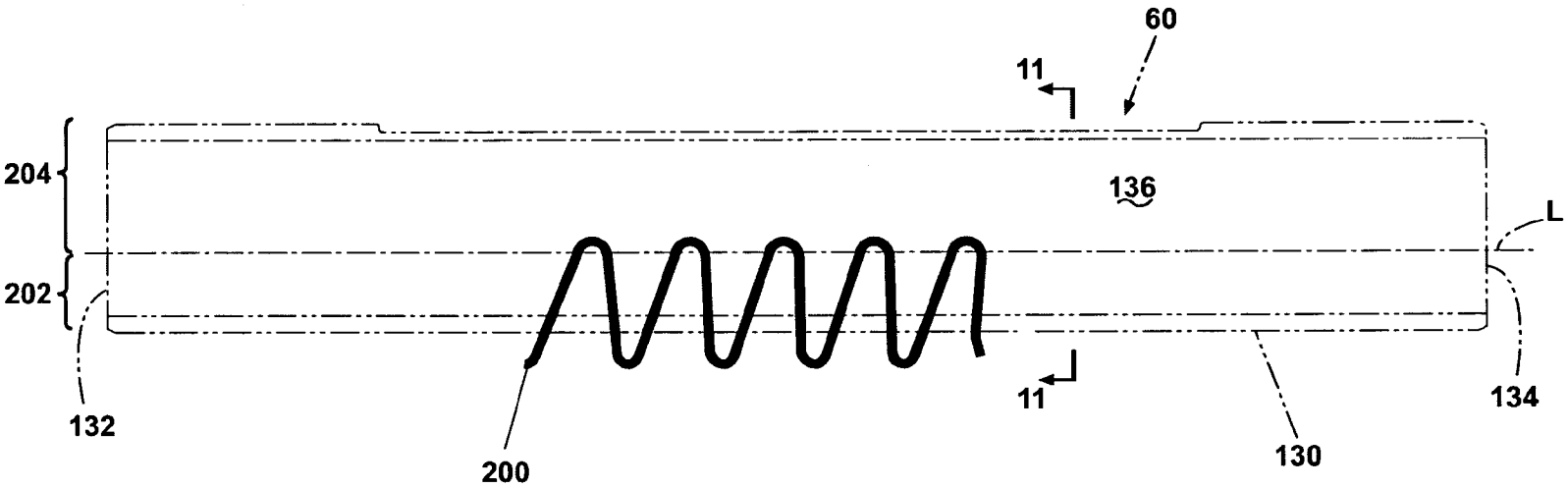
FIG. 10 is a schematic view of a sixth embodiment of a steam generator with a variable thermal output heating element according to the invention.

FIG. 9 illustrates a fifth embodiment of the steam generator 60 according to the invention having the standard heating element 146 replaced by a variable wire size heating element 190. All of the other parts of the steam generator 60 are identical to those previously described. The variable wire size heating element 190 is a substantially straight wire coiled around the steam generation chamber 136 in a generally central location relative to the first and second ends 132, 134. The variable wire size heating element 190 includes a first portion 192 below an operational water level L of the steam generation chamber 136 and a second portion 194 above the operational water level L. The first portion 192 of the variable wire size heating element 190 may be formed of a wire having a larger cross-sectional area than cross-sectional area of the wire forming the second portion 194. In the illustrated embodiment, the wire has a generally circular cross-section. Alternatively, the wire could have a different shape, such as triangular, square, or polygonal. Due to the larger cross-sectional area of the wire in the first portion 192 of the variable size heating element 190, a greater total portion of the variable wire size heating element 190 is located below the operational water level L in the first portion 192. Therefore a greater portion of the thermal output is located below the operational water level than above the operational water level.

The variable wire size heating element 190 may be formed by stretching or rolling a wire of a constant cross-sectional area along portions of the wire that correspond to the second portion 194 of the variable wire size heating element 190. Stretching or rolling the sections of the wire corresponding to the second portion 194 will decrease the cross-sectional area of the wire in the second portion 194 as compared to the cross-sectional area of the wire in the first portion 192.

Figure 11:
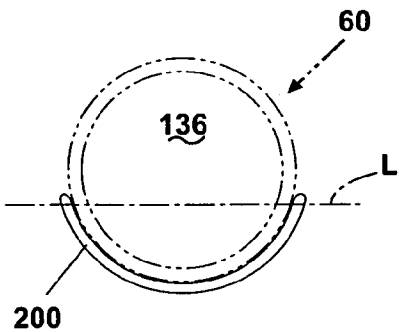
FIG. 11 is a schematic view of the steam generator of FIG. 11 taken along line 11-11 in FIG. 10.

FIG. 11 illustrates a sixth embodiment of the steam generator 60 according to the invention having the standard heating element 146 replaced by a serpentine heating element 200. All of the other parts of the steam generator 60 are identical to those previously described. The serpentine heating element 200 may be serpentine in shape and curves around a portion of the steam generation chamber 136 in a generally central location relative to the first and second ends 132, 134. The serpentine heating element 200 includes a first portion 202 below an operational water level L of the steam generation chamber 136 and a second portion 204 above the operational water level L. In the illustrated embodiment, the wire has a generally circular cross-section. Alternatively, the wire could have a different shape, such as triangular, square, or polygonal. Due to the configuration of the serpentine heating element 200, a greater total length of the wire forming the serpentine heating element is located below the operational water level L.

Figure 12:
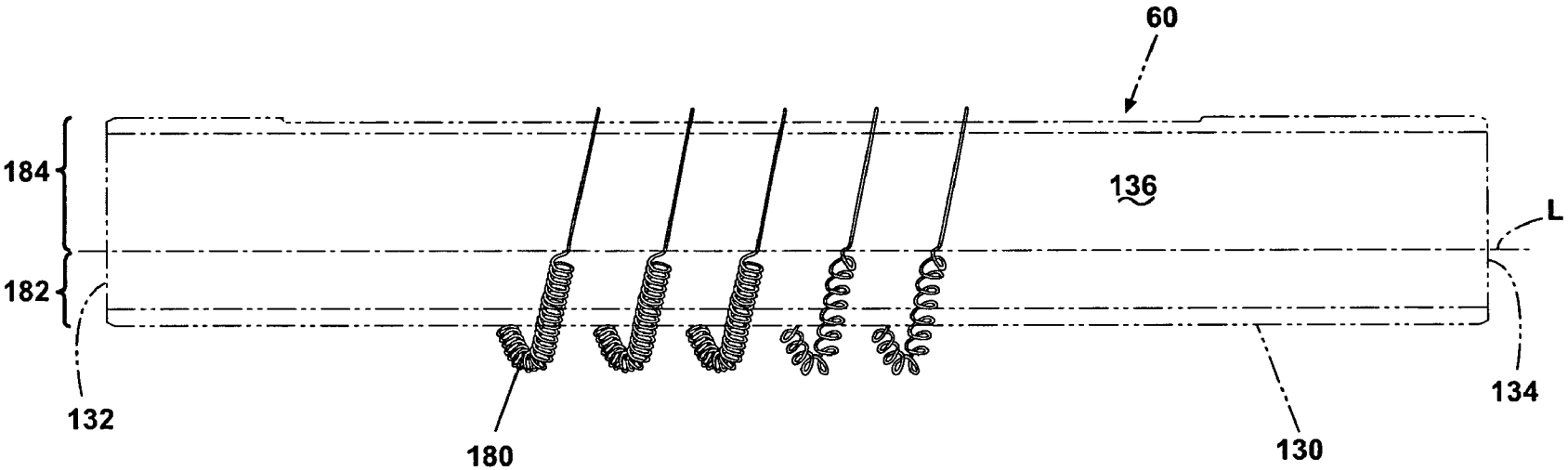
FIG. 12 is a schematic view of a seventh embodiment of a steam generator with a variable thermal output heating element according to the invention.

The serpentine heating element 200 may be formed by bending a wire so as to form a serpentine shape that curves around a portion of the steam generation chamber 136, as is illustrated in FIG. 12. The serpentine heating element 200 may curve primarily around a portion below the operational water level L of the steam generation chamber 136, with only a small portion of the serpentine heating element 200 extending above the operational water level L.

The different approaches of the previously described embodiments can be combined to form a heating element where a greater portion of the thermal output is located below the operational water level than above the operational water level. For example, any of the embodiments of FIGS. 5-8 could incorporate the different cross-sectional areas for the wire forming the coils as disclosed in the non-coiled wire of FIG. 9. The non-coiled wire of FIG. 9 could be used with a coiled or partially coiled wire as disclosed in any of FIGS. 5-8. The smaller diameter coils of FIG. 7 and the different pitch coils of FIG. 5 could be stretched as in FIG. 6. The different pitch coils of FIG. 6 could be used with the smaller diameter coils of FIG. 8. These examples are merely illustrative and not limiting. The different approaches can be used alone or together to create a heating element that is discretely or continuously variable in its thermal output.

While the variable thermal output heating element has been described up to this point as varying the output relative to the top and bottom of the steam generator, it can also be applied to vary the thermal output from end-to-end. For example, it may be beneficial to vary the thermal output from the inlet end to the outlet end. One such approach is illustrated in FIG. 12, which illustrates the heating element of FIG. 8 with the coils of the first portion 182 varying in pitch for each winding. The first three windings, when viewed in FIG. 12 from left to right, have more windings per unit length than the last two windings. This places more of the thermal output at the inlet, which more quickly heats the entering water.

Although the heating elements of the various embodiments described above are illustrated as being coiled around an exterior of the tube 130, the heating elements may alternatively be coiled within the steam generation chamber 136 along an interior of the tube 130.

The steam generator 60 may be employed for steam generation during operation of the washing machine 10, such as during a wash operation cycle, which may include prewash, wash, rinse, and spin steps, during a washing machine cleaning operation cycle to remove biofilm and other undesirable pests from the washing machine, during a refresh or dewrinkle operation cycle, or during any other type of operation cycle. The steam generator 60 may also be employed to clean the steam generator 60 itself. An exemplary operation of the steam generator 60 is provided below.

To operate the steam generator 60, water from the water supply 29 may be provided to the steam generator 60 via the valve 34, the second supply conduit 62, the water supply conduit 104, and the tank 90. Water that enters the tank 90 from the water supply conduit 104 fills the volume of the tank 90 between the steam generator inlet and the tank bottom 92 to thereby form the water plug. Once the water reaches the steam generator inlet at the first end 132 of the steam generator tube 130, the water flows into the steam generator tube 130 and begins to fill the steam generation chamber 136 and, depending on the configuration of the steam generator 60 and the steam conduit 66, possibly a portion of the steam conduit 66. In the exemplary embodiment, the water that initially enters the steam generation chamber 136 fills the steam generation chamber 136 and the steam conduit 66 to a level corresponding to the water plug without a coincident rise in the water level in the tank 90. Once the water fills the steam generation chamber 136 to the level corresponding to the water plug, further supply of water from the water supply conduit 104 causes the water levels in the tank 90 and the steam generation chamber 136 to rise together as a single water level. If the steam generation chamber 136 becomes completely filled with water, further supply of water from the water supply conduit 104 causes the water level in the tank 90 to further rise. Due to the pull of gravity, the water supplied to the steam generation chamber 136 will fill the steam generation chamber 136 from the bottom up.

Water may preferably be supplied to the operational water level L, which is typically less than a maximum water level corresponding to filling a total volume of the steam generation chamber 136. The operational water level L may correspond to a level of water present in the steam generation chamber 136 when the steam generation chamber is filled to a volume optimal for steam generation. Although the operational water level L is illustrated as a single level, the actual level of water present in the steam generation chamber 136 during operation of the steam generator 60 may vary. For example, the water is normally supplied to the steam generator based on time or to a sensed level. Steam is then created which lowers the water level. At some point the water level may drop low enough that water is re-supplied to prevent the steam generator from running out of water. Alternatively, the water may be re-supplied continuously or at discrete times to keep the water level within a desired range. In some in-line or flow through steam generators, the operational water level may vary from 5% to 50% of the total volume. In tank-type steam generators, the percentage may be much higher and very close to 100%. Moreover, when steam is being generated, the creating of bubbles in the water makes the water very turbulent and the water level may change quickly. Thus, the operational water level L may be thought of more as an expected, target, or effective water level and typically is machine and process dependent.

At any desired time, the heat source 138 may be activated to generate heat to convert the water in the steam generation chamber 136 to steam. For example, the heat source 138 may be activated prior to, during, or after the supply of water. Because a greater total portion of the heating element 150, 160, 170, 180, 190, 200 according to the invention is present in a first portion 152, 162, 172, 182, 192, 202 of the heating element positioned below the operational water level L, thermal output from the heating element is concentrated on the water present in the steam generation chamber 136. This is because the thermal output is uniform along the length of the wire, so allocating a greater total length of wire to the first portion 152, 162, 172, 182, 192, 202 provides greater thermal output to the first portion. Water may be converted to steam by the addition of heat, but steam will only increase in temperature by the addition of heat. By concentrating the thermal output to areas of the steam generator 60 that have the greatest effect on creating steam, namely the area below the operational water level L, steam is generated more efficiently, and less heat is lost to the areas surrounding the steam generator 60.

Additionally, the steam generator 60 is less likely to malfunction due to a buildup of scale or calcification by implementing the inventive heating element. When the thermal output from the heating element is concentrated towards the area below the operational water level L, steam, air, and vapor present in the steam generation chamber 136 above the operational water level L is cooler. Because higher temperatures convert soft calcium to hard calcium, which is more difficult to remove than soft calcium, the asymmetric thermal output provided by the inventive heating output reduces the amount of hard calcium buildup.

Steam generated in the steam generation chamber 136 flows from the steam generator tube 130 and through the steam conduit 66 to the treatment chamber. In some circumstances, such as, for example, excessive scale formation or formation of other blockage in the steam generator 60 or the steam conduit 66, the steam may attempt to flow upstream to the water supply 29 rather than to the treatment chamber. However, the water plug between the steam generator inlet and the outlet of the water supply conduit 104 blocks steam from flowing from the steam generation chamber 136 backwards into the water supply conduit 104 and to the water supply 29.

During the operation of the washing machine 10, the siphon break device may prevent water or other liquids from the tub 14 and/or the drum 16 from undesirably flowing to the water supply 29 via the steam generator 60. Any siphoned liquids may flow through the steam generator 60, into the reservoir 64, through the water supply conduit 104, and through the siphon break conduit 116 (FIG. 2) to the atmosphere external to the washing machine 10 or other suitable location. The siphoned liquids may flow through the siphon break conduit 116 rather than through the second supply conduit 62 to the water supply 29. This type of siphon break device is commonly known as an air-gap siphon break, but it is within the scope of the invention for any type of siphon break device to be coupled with the reservoir 64. Further, it is also within the scope of the invention for the siphon break device to be separate from the reservoir 64 or for the reservoir 64 to be employed without the siphon break device.

While the invention has been specifically described in connection with certain specific embodiments thereof, it is to be understood that this is by way of illustration and not of limitation, and the scope of the appended claims should be construed as broadly as the prior art will permit.

What is claimed is:

1. A fabric treatment appliance comprising:

a receptacle defining a fabric treatment chamber for receiving laundry; and a steam generator comprising:

an inlet coupled with a water supply for receiving water;

a steam generation chamber for converting the water to steam;

an outlet coupled with the fabric treatment chamber for supplying steam to the fabric treatment chamber; and a heating element thermally coupled with the steam generation chamber and having at least a first portion below an operational water level of the steam generation chamber and at least a second portion above the operational water level, with the first portion having a greater thermal output per unit length along a longitudinal axis of the heating element than the second portion; and wherein the heating elements wraps around the steam generation chamber.

2. The fabric treatment appliance according to claim 1 wherein the first portion of the heating element has a greater cross-sectional area than the second portion.

3. The fabric treatment appliance according to claim 1 wherein the first portion comprises a greater portion of a total length of the heating element than the second portion.

4. The fabric treatment appliance to claim 1 wherein the heating element comprises multiple coils, with the first portion comprising more coils per unit length of the heating element than the second portion.

5. The fabric treatment appliance according to claim 4, wherein the second portion comprises coils having a greater pitch than the coils of the first portion.

6. The fabric treatment appliance according to claim 4, wherein the second portion comprises coils having a smaller cross-sectional area than the coils of the first portion.

7. The fabric treatment appliance according to claim 4, wherein the second portion comprises a non-coiled portion.

8. The fabric treatment appliance according to claim 7, wherein the second portion has no coils.

9. The fabric treatment appliance according to claim 4, wherein the second portion comprises coils that are stretched.

10. The fabric treatment appliance according to claim 1, wherein the second portion has a cross-sectional area less than the first portion.

11. The fabric treatment appliance according to claim 1 wherein the heating element comprises an elongated wire.

12. The fabric treatment appliance according to claim 1 wherein the heating element is serpentine in shape.

13. The fabric treatment appliance according to claim 1 wherein the operational water level is less than a maximum water level in the steam generation chamber.

14. A steam generator comprising:

an inlet configured to couple to a water supply, for receiving water;

a steam generation chamber for converting the water to steam;

an outlet through which steam generated in the steam generation chamber may escape; and a heating element thermally coupled with the steam generation chamber and having a first portion below an operational water level of the steam generation chamber and a second portion above the operational water level, with the first portion having a greater thermal output per unit length along a longitudinal axis of the heating element than the second portion; and wherein the heating element wraps around the steam generation chamber.

15. The steam generator according to claim 14 wherein the first portion of the heating element has a greater cross-sectional area than the second portion.

16. The steam generator according to claim 14 wherein the first portion comprises a greater portion of a total length of the heating element than the second portion.

17. The steam generator according to claim 14 wherein the heating element comprises multiple coils, with the first portion comprising more coils per unit length of the heating element than the second portion.

18. The steam generator according to claim 14 wherein the heating element comprises an elongated wire.

19. The steam generator according to claim 14 wherein the heating element is serpentine in shape.

20. The steam generator according to claim 14 wherein the operational water level is less than a maximum water level in the steam generation chamber.

21. The steam generator according to claim 14 wherein the second portion comprises at least one of the following:

a cross-sectional area less than the cross-sectional area of the first portion;

a lesser portion of a total length of the heating element than the first portion;

coils at a lower amount per unit length than the first portion;

coils having a greater pitch than the first portion;

a non-coiled portion;

coils that are stretched along a longitudinal axis of the heating element; and coils having a smaller effective diameter than the first portion.

22. A fabric treatment appliance comprising:

a receptacle defining a fabric treatment chamber for receiving laundry;

a water supply;

a steam generator comprising:

an inlet coupled with the water supply for receiving water;

a steam generation chamber for converting the water to steam;

an outlet coupled with the fabric treatment chamber for supplying steam to the fabric treatment chamber; and a heating element thermally coupled with the steam generation chamber and having at least a first portion below an operational water level of the steam generation chamber and at least a second portion above the operational water level, with the first portion having a greater thermal output per unit length along a longitudinal axis of the heating element than the second portion;

wherein the water supply provides water to the steam generator to form the operational water level thereby segregating the steam generation chamber into a portion filled with water and a portion containing at least one of steam, air, and vapor, and the first portion of the heating element concentrates the thermal output of the heating element on the water present in the steam generation chamber; and wherein the heating element wraps around the steam generation chamber.

* * * * *

UNITED STATES PATENT AND TRADEMARK OFFICE

CERTIFICATE OF CORRECTION

PATENT NO. : 7,905,119 B2
APPLICATION NO. : 11/848550
DATED : March 15, 2011
INVENTOR(S) : Robert J. Pinkowski et al.

It is certified that error appears in the above-identified patent and that said Letters Patent is hereby corrected as shown below:

Col. 13, lines 64-67, Claim 4: "The fabric treatment appliance to claim 1 wherein the heating element comprises multiple coils, with the first portion comprising more coils per unit length of the heating element than the second portion." - should be Claim 4: -- The fabric treatment appliance according to claim 1 wherein the heating element comprises multiple coils, with the first portion comprising more coils per unit length of the heating element than the second portion. --

Col. 14, lines 24-39, Claim 14: "A steam generator comprising: an inlet configured to couple to a water supply, for receiving water; a steam generation chamber for converting the water to steam; an outlet through which steam generated in the steam generation chamber may escape; and a heating element thermally coupled with the steam generation chamber and having a first portion below an operational water level of the steam generation chamber and a second portion above the operational water level, with the first portion having a greater thermal output per unit length along a longitudinal axis of the heating element than the second portion; and wherein the heating element wraps around the steam generation chamber." - should be Claim 14: -- A steam generator comprising: an inlet configured to couple to a water supply for receiving water; a steam generation chamber for converting the water to steam; an outlet through which steam generated in the steam generation chamber may escape; and a heating element thermally coupled with the steam generation chamber and having a first portion below an operational water level of the steam generation chamber and a second portion above the operational water level, with the first portion having a greater thermal output per unit length along a longitudinal axis of the heating element than the second portion; and wherein the heating element wraps around the steam generation chamber. --

Signed and Sealed this
Third Day of July, 2012

David J. Kappos

David J. Kappos
*Director of the United States Patent and Trademark Office*